United States Patent [19]

Clark

[11] 4,322,171

[45] Mar. 30, 1982

[54] GRAIN STIRRING APPARATUS

[76] Inventor: Donald Y. Clark, R.R #1, Central City, Merrick County, Nebr. 68826

[21] Appl. No.: 197,881

[22] Filed: Oct. 17, 1980

[51] Int. Cl.[3] ..... B01F 7/24; B01F 7/30

[52] U.S. Cl. ..... 366/261; 74/110; 366/287; 366/289

[58] Field of Search ..... 366/241, 261, 281-284, 366/287, 289, 83-86, 202, 203, 210, 212, 297-301, 603; 74/110; 414/287

[56] References Cited

U.S. PATENT DOCUMENTS

| | | | |
|---|---|---|---|
| 3,584,842 | 6/1971 | Sukup | 366/261 |
| 3,592,447 | 7/1971 | Steffen | 366/261 |
| 4,162,857 | 7/1979 | Spurling | 366/261 |
| 4,248,538 | 2/1981 | Sukup | 366/261 |

*Primary Examiner*—Philip R. Coe
*Assistant Examiner*—Timothy F. Simone
*Attorney, Agent, or Firm*—Henderson & Sturm

[57] ABSTRACT

A grain bin stirring apparatus with a horizontal support member for radially reciprocating down augers, said support member rotating in an arcuate path around the bin wherein the center-most reciprocating auger travels twice as far radially as the other augers through a cable and pulley arrangement. The down augers are caused to move radially by a pivoting link which transmits a programmed extent and speed of motion and the power source is geared to drive both the auger carriage units radially and the support member in an arcuate path.

10 Claims, 8 Drawing Figures

GRAIN STIRRING APPARATUS

BACKGROUND OF THE INVENTION

The present invention relates generally to grain stirring apparatus as for use in storage bins employing multiples of down augers carried on a horizontal support member which moves in an arcuate path about the center point of a circular bin, and more particularly to those devices which reciprocate the augers radially back and forth along the support member as it moves in order to accomplish more complete coverage of the grain.

The prior art reciprocates the down augers in circular bins as the support member revolves about the center point in order to cover substantially every square inch of horizontal cross sectional area and thereby eliminate the problem of dead zones which occur between the auger paths or non-reciprocating stirring apparatuses. A common feature of the prior art reciprocating stirring apparatuses is that the multiples of augers move back and forth in unison with each other, either because they are propelled by the same drive or because they depend from a single carriage. As a consequence of this unified motion, the coverage of substantially all horizontal cross sectional area without overlap requires that the augers be evenly spaced along the beam. This even spacing results in uneven stirring, and hence drying, due to the fact that the further each auger is located from the center point the more grain it must stir per revolution of the auger support beam.

Over stirring of grain in the central area of a bin results in more serious problems than the apparent overuse of equipment and wasted energy costs. The centrally located grain is actually augered to the top so often, as compared to the other grain, that it dries at a slower rate due to the fact that drying is usually accomplished by warm air being forced upwards through the grain after exiting from a perforated floor. In addition, the more frequent stirring results in heaping towards the bin center and consequent air flow routes which bend outwardly away from the vertical. The cumulative effect is early drying of the perimeter grain, and eventually over-drying thereof, in order to adequately dry the center portion. This phenomena occurs even though the outer portion was subject to less stirring.

SUMMARY OF THE INVENTION

The present invention has the effect of replacing two reciprocating augers with one auger, yet still covering the same zone. Thus, for example, a four auger support beam which provided for a three foot reciprocating travel for each auger might be employed to stir an area having a twelve foot radius, adding the distance across all four evenly spaced augers of nine feet to the three feet radial travel. Although any two adjacent augers could be replaced by one by use of the present invention, it is contemplated that the problem outlined hereinabove would dictate that the two innermost augers be replaced by a single auger. The apparatus of this invention comprises a cable and pulley arrangement which, in the example outlined above, would move the single auger which replaced the two innermost augers a total of six feet while the two remaining outermost augers were travelling three feet. All three augers end and begin their radial movement together, the radial movement of the innermost auger being twice as far and twice as fast. While obviously, this invention does not present an ideally perfect solution to the problem, it does generalize a result of a material reduction of stirring in the central portion, or any desired zone, of a bin and it does so without leaving any dead zones.

An object of the present invention is the provision of an improved grain bin stirring apparatus.

Another object is to provide a multiple reciprocating stirring apparatus which promotes even drying of grain.

A further object is to provide a multiple reciprocating stirring apparatus with materially less overstirring where it tends to occur.

Still another object is to provide a multiple reciprocating stirring apparatus with reduced stirring activity in selected zones while still covering an entire area.

A still further object of the invention is the provision of a multiple reciprocating stirring apparatus with a single auger which will travel twice the radial distance of the other augers in the same time.

Yet another object is to provide a multiple reciprocating stirring apparatus which requires fewer augers and less power and maintenance to operate.

Other objects, advantages and novel features of the present invention will become apparent when considered in conjunction with the accompanying drawings and the detailed description which follows.

and

FIG. *7a* is a side elevational view of the apparatus showing auger carriage units in their outermost position.

DESCRIPTION OF THE PREFERRED EMBODIMENT

Figure 1:
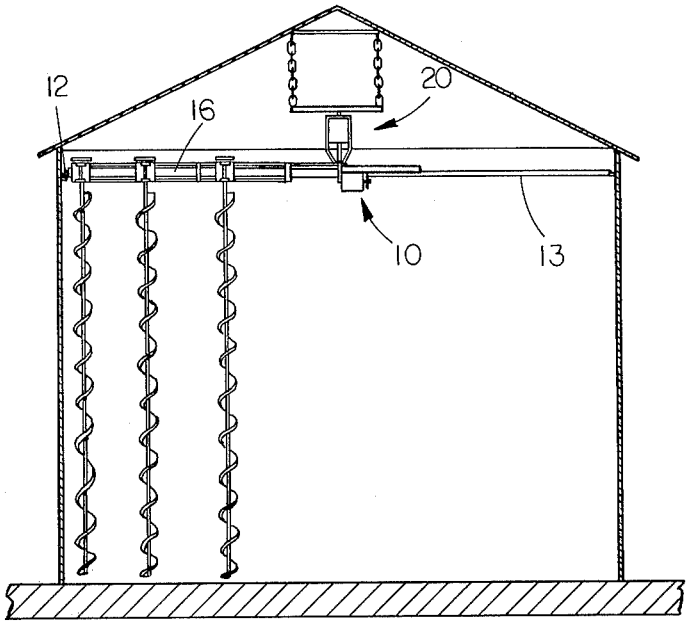
FIG. 1 is a section of a bin for storing and drying grain having mounted therein the stirring apparatus of this invention.
Figure 2:
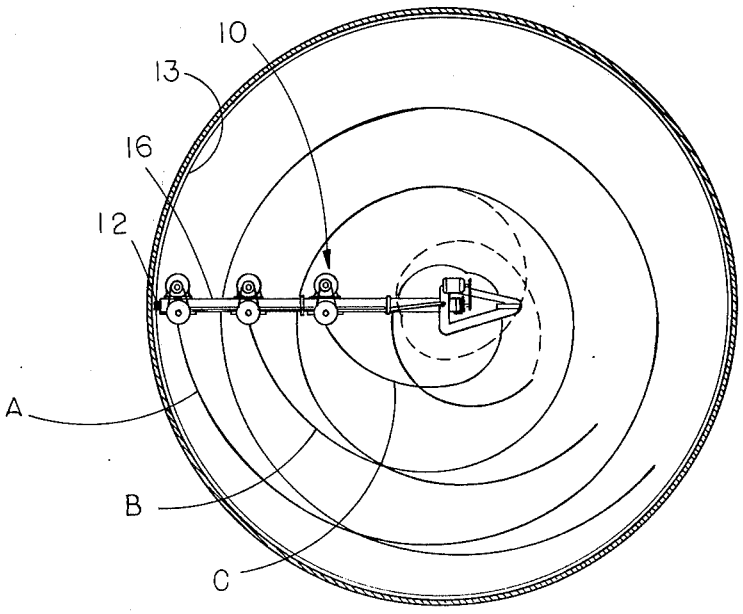
FIG. 2 is a cross section of the bin of FIG. 1 taken along lines 2—2 of FIG. 1 and showing the augers' paths of the preferred embodiment.

Referring now to the drawings wherein like reference numerals designate identical or corresponding parts throughout the several views, and more particularly to FIGS. 1 and 2 wherein the grain bin stirring apparatus is designated generally at 10, the apparatus is shown suspended in a grain bin above the level at which grain is stored. In this embodiment the apparatus is suspended at one end by a center hanging structure, designated generally at 11, which is centered in the grain bin and provides for the free rotation of the apparatus about the grain bin center, as well as structure for a constant supply of power to the apparatus, in a conventional manner well known in the art. At its other end it is supported through traction wheel 12 resting on wall track assembly 13. As can be seen more clearly in FIGS. 4 and 5, wall track assembly 13 is secured to the upper perimeter of the inside bin wall by spaced apart brackets or the like (not shown) and traction wheel 12 is secured co-axially to a main shaft and bearing assembly 14 which runs longitudinally through horizontal support member 16. The two bearings of main shaft and bearing assembly 14, which are not shown, are secured within horizontal support member 16 near either end thereof. For purposes of designating various assemblies, structures, and areas of activity, that segment of horizontal support member 16 which lies betwen the center of the bin about which horizontal support member 16 rotates and the bin wall is designated as its major segment 17; the remaining segment of horizontal support member 16 which extends beyond the center of the bin is designated as minor segment 18.

Horizontal support member 16 is essentially rectangular in cross section with its top and bottom oriented horizontally, in order that the various types of down auger carriage units, each of which are hereinafter separately described, may freely move thereupon on sets of simple axle and wheel assemblies 15 by which they are carried. Due to the horizontal orientation of the top and bottom of horizontal support member 16, said wheel assemblies 15 can roll back and forth on both the top and bottom of horizontal support members 16 as it is moved in an arcuate path around the bin by traction wheel 12.

Figure 4:
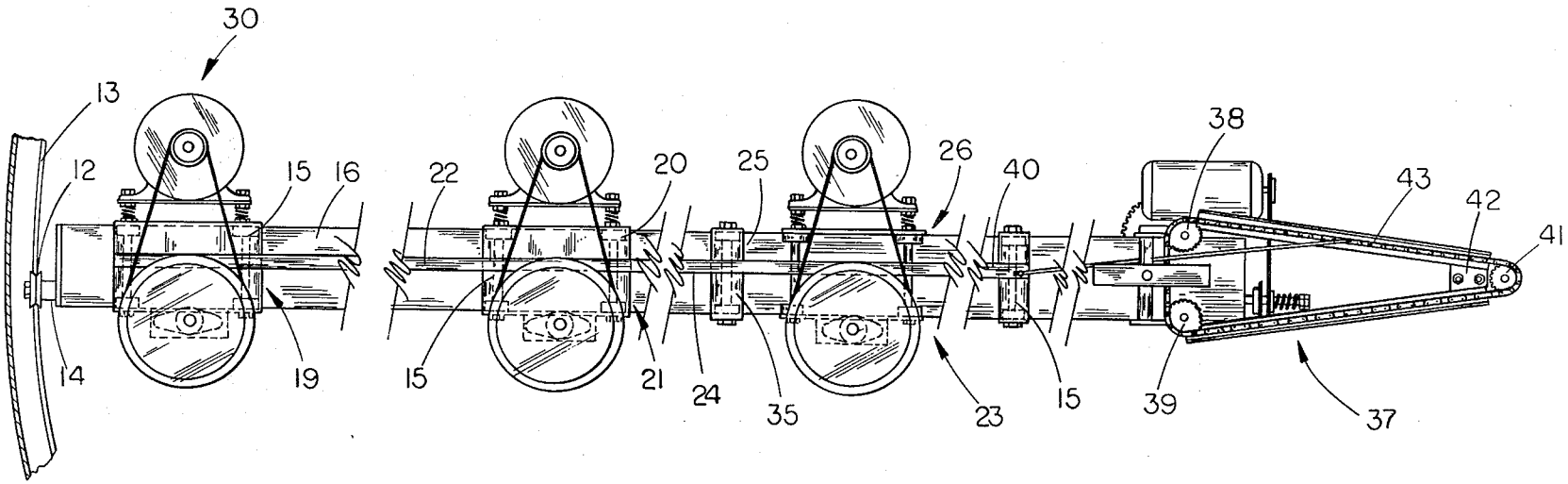
FIG. 4 is an enlarged, fore-shortened, top plan view of the apparatus of the invention.
Figures 5, 6:
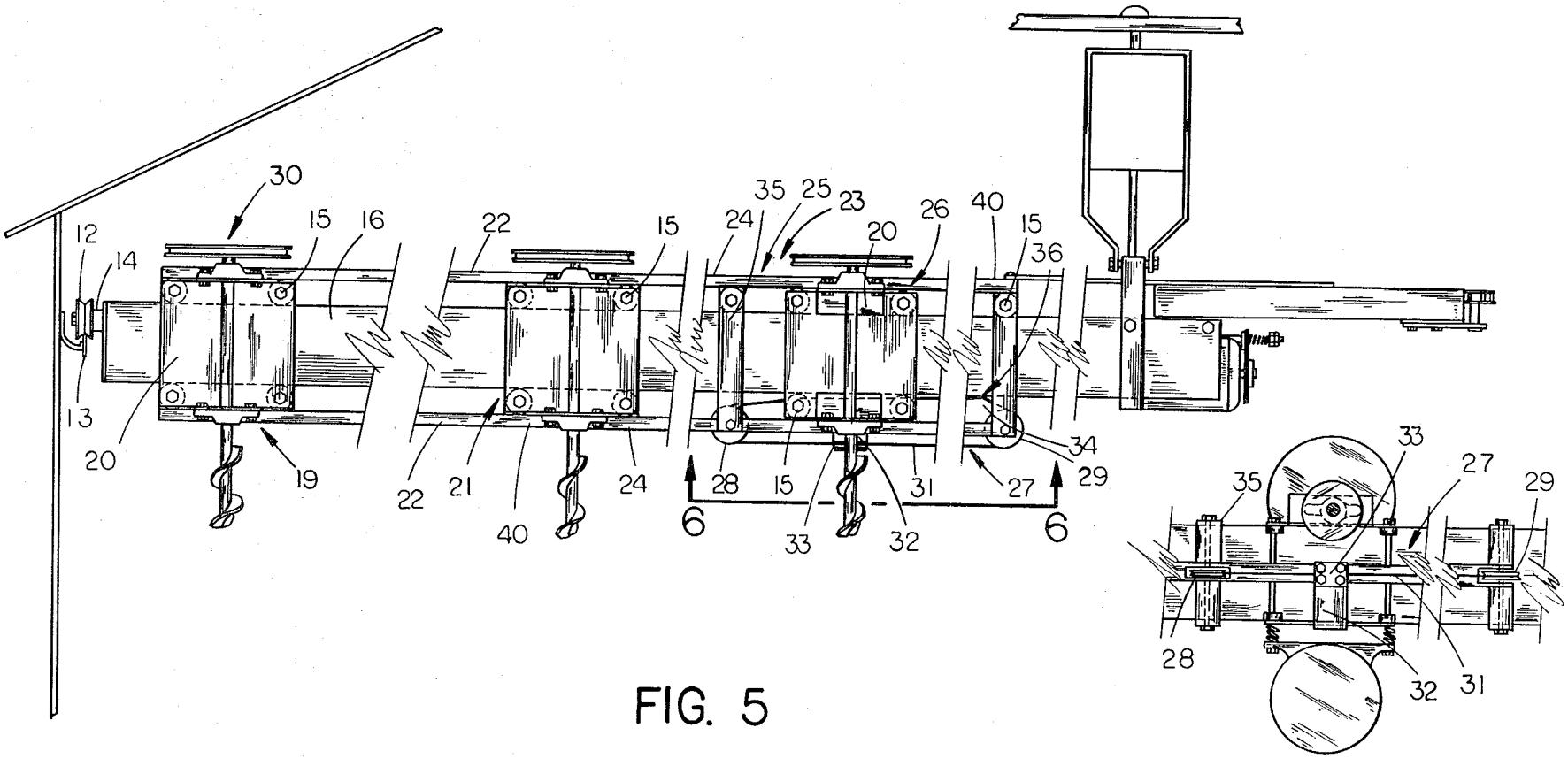
FIG. 5 is an enlarged, fore-shortened, side elevational view of the apparatus of the invention.
FIG. 6 is an enlarged, fragmentary bottom plan view taken at line 6—6 of FIG. 5.

In this embodiment a simple auger carriage unit 19, as can best be seen in FIGS. 4 and 5, is located nearest the bin wall. It is comprised of rectangular frame 20 which is supported by four wheel and axle assemblies 15 and down auger assembly 30 having conventional parts which include a motor, a pulley, a drive belt and an auger with bearings. The next auger carriage unit, moving towards the bin center, is designated as secondary auger carriage unit 21 and differs from simple auger carriage unit 19 only in that it is considered to include rigid connection 22, which is comprised of two rigid horizontal bars one above and one below horizontal support member 16 which are fixedly secured to both the rectangular support frame 20 of secondary auger support carriage 21 and the rectangular support frame 20 of simple auger support carriage 19. Rigid connection 22 is of a length in this embodiment such that it will maintain the down auger assembly 30 of simple carriage unit 19 a distance away from the down auger assembly 30 of secondary carriage unit 21 equal to substantially one-fourth the length of the major segment 17 of horizontal support unit 16 away from each other. This relationship will enable the down augers of simple carriage 19 and secondary carriage 21 to stir that grain located within substantially the outer one-half radial segment of the circular area of the grain bin without overlapping their segmental coverage in a manner which will be explained later.

Figure 7:
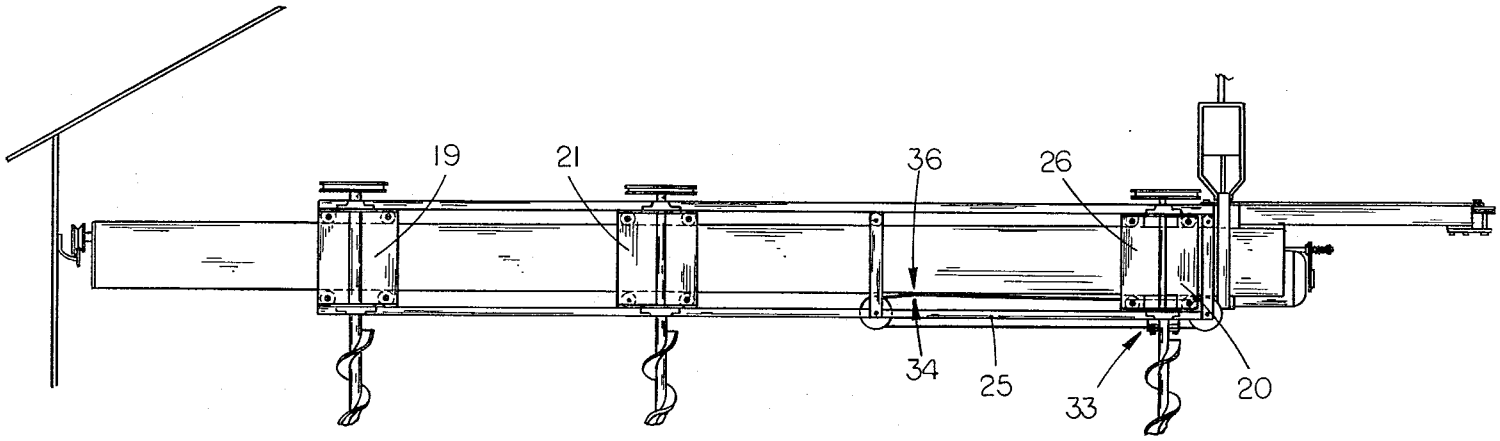
FIG. 7 is a side elevational view of the apparatus showing auger carriage units in their center-most position.
Figure 7A:
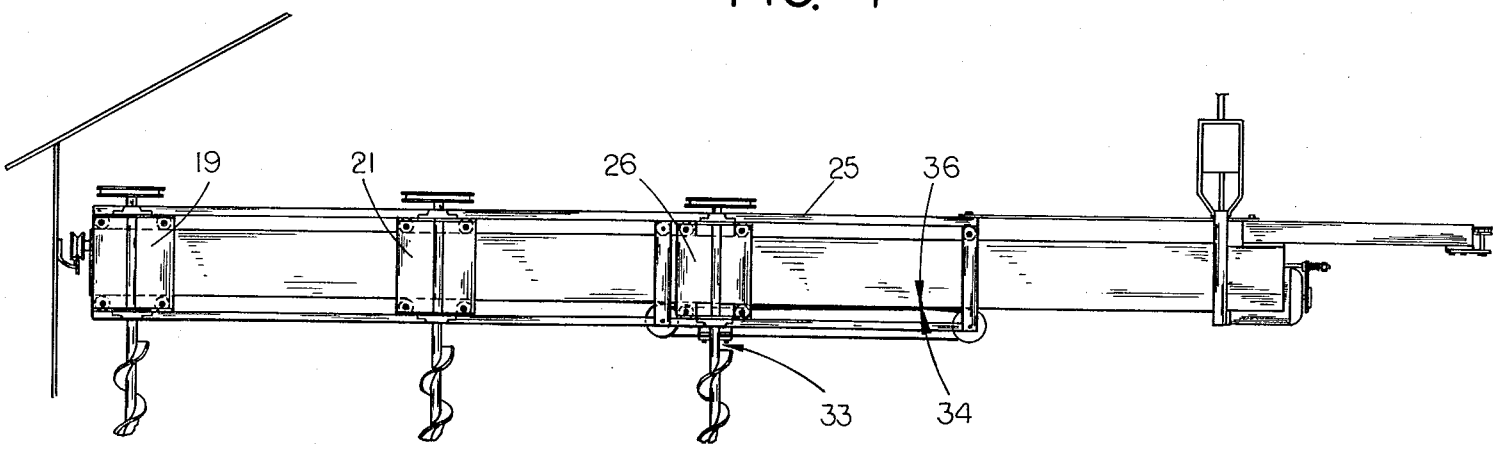

Located nearest the bin center is complex auger carriage unit 23, which, like secondary carriage unit 21, includes a rigid connection rod 24 which is fixedly secured to open framework 25 both above and below horizontal support structure 16 and to the rectangular support frame 20 of secondary auger carriage unit 21. The length of rigid connection 24 will be described and explained after complex auger carriage unit 23 is completely described. Open framework 25, as can be better understood by viewing FIGS. 7 and 7*a*, is comprised of two rectangular frame ends 35 and two horizontal frame end connectors 40 so as to leave an unobstructed space along horizontal support member 16 within open framework 25 equal in length to slightly more than the distance the simple and secondary auger carriage units are spaced apart. Subordinate auger carriage unit 26 moves within the unobstructed space within open framework 25.

Except for the manner in which it is connected to the other carriage units, subordinate auger carriage unit 26 and its parts are identical to simple auger carriage unit 19. It is connected to the complex auger carriage unit 23 through cable and pulley assembly 27 and consequently to the other auger carriage units through rigid connections 22 and 24. The upper and lower horizontal portions of rectangular frame 20 are not shown (but could be used for extra rigidity) since wheel and axle assemblies 15 may serve their function of connecting the vertical portions of frame 20 together and the function of providing a connection to end connector 40 of open framework 25 of complex auger carriage unit 23 is otherwise provided. As best can be seen on FIGS. 5 and 6, cable and pulley assembly 27 includes a first pulley wheel assembly 28 which freely rotates within an opening in open framework 25 located in the lower member of horizontal frame end connector 40 near where the lower part of rigid connection 24 adjoins it, second pulley wheel assembly 29 which freely rotates at the opposite end of open framework 25 in an opening in the lower member of frame end connector 40, continuous cable 31 which runs a course about first pulley wheel assembly 28 and second pulley wheel assembly 29, and subordinate carriage connection structure 32. Connection structure 32 is rigidly affixed to rectangular support frame 20 of subordinate auger carriage unit 26 in a position and is of a shape such that it may be rigidly connected to a point 33 on continuous cable 31 in a manner allowing cable 31 to substantially maintain its course about pulley assemblies 28 and 29. At a second point 34 on cable 31, cable 31 is fixedly attached at point 36 to the bottom side of horizontal support member 16. Second point 34 is approximately one-half the length of continuous cable 31 away from point 33 and point 36 on horizontal support member 16 is a distance away from the bin center a distance equal to approximately one-fourth the length of major segment 17 of horizontal support member 16. Again referring to FIGS. 7 and 7*a*, it can be seen that point 36 must always be located within open framework 25 and that when complex auger carriage unit 23 is in a position furthest from the bin center subordinate auger carriage unit 26 is also furthest from the bin center, and when complex auger carriage unit 23 is nearest the bin center subordinate auger carriage unit 26 is also nearest the bin center.

Now that the structure and functioning of complex auger carriage unit has been described, the length of rigid connection 24 is best described and explained. Its length will be that distance between secondary auger carriage unit 21 and complex auger carriage unit 23 which exists when both are in the furthest possible position from the bin center, said length being approximately one-fourth the length of major segment 17. This relationship exists because point 36 has been set at substantially the quarterpoint of major segment 17 of support member 16 nearest the bin center, the unobstructed space within open framework 25 is but slightly more than one-fourth the length of major segment 17 and the distance between rectangular frame 20 of simple auger carriage 19 and rectangular frame 20 of secondary auger carriage 21 is also one-fourth of major segment 17 leaving only approximately one-fourth of major segment 17 for the length of rigid connection 24.

It should be appreciated that rigid connection 22, rigid connection 24, and horizontal frame end connector 40 all have an upper and lower portion, all are connected end-on-end both above and below support member 16 and, in this embodiment they actually comprise two single bars, one above and one below support member 16. The result of these relationships is that the three auger carriage units will form a rigid over-all unit of a length approximately three-quarters that of the major segment 17 of the horizontal support unit 16 which is free to move back and forth along major segment 17 of horizontal support member 16 a distance equal to roughly one-fourth the length of major segment 17. Furthermore, because of the particular way in which continuous cable 31 connects complex auger carriage unit 23 to subordinate auger carriage unit 26 and horizontal support member 16, when the over-all unit is made to slide back and forth along horizontal support member 16 as aforesaid, subordinate auger support unit 26 will travel a distance equal to roughly one-half the length of major segment 17 of horizontal support member 16 at the same time simple auger carriage unit 19 and secondary auger carriage unit 21 are travelling the one-fourth portion of major segment 17 of horizontal support member 16 which they are free to move along.

As can be readily seen, in FIG. 7, when subordinate auger carriage unit 26 is next to the center of the bin secondary auger carriage unit 21 is next to the mid-point of major segment 17, and as can be seen in FIG. 7*a*, when subordinate auger carriage unit 26 is near the mid-point of major segment 17 of horizontal support member 16 secondary auger carriage unit 21 has moved only so far as one-fourth the length of major segment 17 towards the bin wall. This characteristic of the invention is due to the mechanical advantage achieved through the cable and pulley assembly 27 and accomplishes complete down auger coverage of the entire circular area of the bin with three augers rather than four, all the while reducing the stirring activity in the central portion covered by the down auger carried by subordinate auger carriage unit 26 to half what it would be were two augers employed, and therefore, more in proportion to the stirring coverage of the down augers carried by simple auger carriage unit 19 and secondary auger carriage unit 21.

Figure 3:
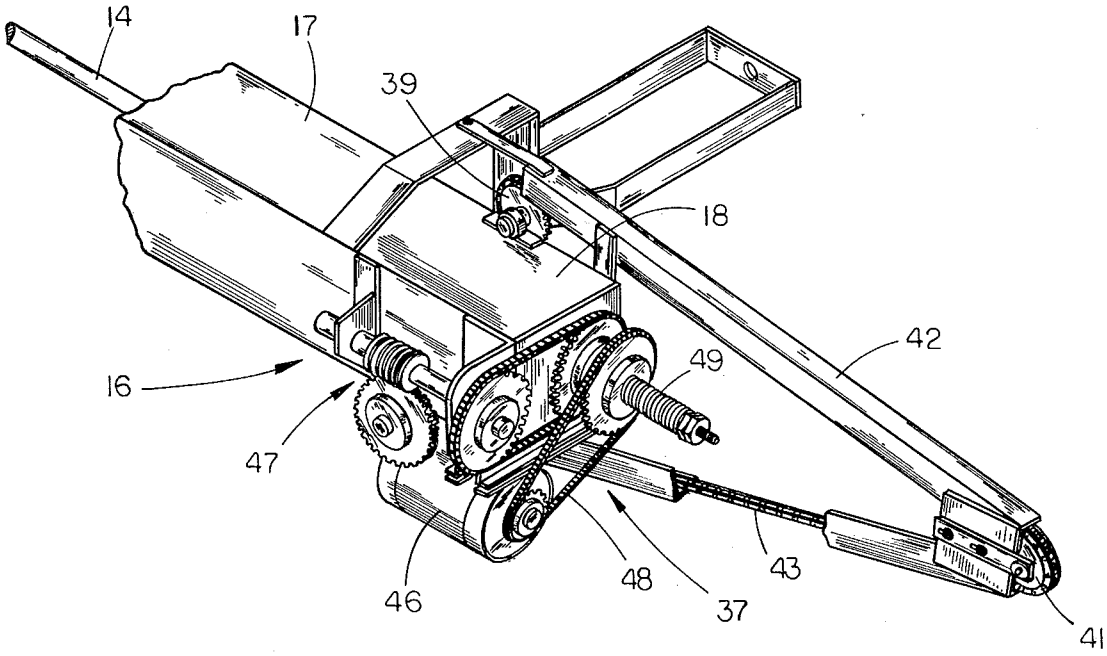
FIG. 3 is a fragmentary bottom perspective view of a minor segment of a horizontal support member showing a power transmission structure for a drive shaft and a programmed carriage drive and assembly of this invention.

In this embodiment of the invention, the rigid over-all unit formed by the three auger carriage units is moved back and forth along horizontal support member 16 by a programmed carriage drive assembly which can best be understood by reference to FIGS. 3 and 4 and is designated generally at 37. It is comprised of drive sprocket wheel and bearing assembly 38 which is secured to the minor segment 18 of support member 16 near its top horizontal surface such that its drive sprocket wheel will be in approximately the same plane as the upper portion of horizontal frame end connector 40, a base guide sprocket wheel and bearing assembly 39 which is secured to minor segment 18 of support member 16 symmetrically opposite to drive sprocket wheel 38, apex guide sprocket wheel and bearing wheel assembly 41 including A-frame support 42 which is secured to minor segment 18 of support member 16 in a manner such that the three sprocket wheels (drive sprocket wheel 38, base guide sprocket wheel 39, and apex guide sprocket wheel 41) form an isosceles triangle, continuous flexible chain 43 which runs a course about said three sprocket wheels, and linkage rod 44 which is pivotally connected at one end to a link of continuous flexible chain 43 and at its other end to the proximal upper end of horizontal frame end connector 40.

The length of linkage rod 44 is that which is necessary to span the distance between its pivotal connection with horizontal frame end connector 40 and the link of continuous flexible chain 43 to which it is connected, when all three auger carriage units are at their furthest distance from the bin center and when the link to which it is connected is approximately mid-way between drive sprocket wheel 38 and base guide sprocket wheel 39. The height of the isosceles triangle forming A-frame 42 is such that when the three auger carriage units are in their nearest position to the bin center, the link to which linkage rod 44 is pivotally connected is on apex guide sprocket wheel 41 and at its maximum distance from the other two sprocket wheels.

Due to this configuration of the sprocket wheels, with respect to their inter-related locations, as drive sprocket wheel 38 turns the programmed carriage drive assembly 37, the over-all unit of the three auger carriage units will move back and forth at an even rate from a position furthest from the bin center to a position nearest the bin center a distance equal approximately to one-fourth the length of major segment 17 of support member 16 while completely covering the entire cross sectional area of the grain bin and will stop momentarily in the outermost position, a length of time represented by and in proportion to, the base of the isosceles triangle formed by the three sprocket wheels. As can be readily understood, other patterns of movement can be predetermined by the position of the sprocket wheels. For illustration purposes, a diagram of the stirring coverage of the three down augers of this embodiment is indicated on FIG. 2 wherein the path of simple auger carriage unit 19 is designated by the letter "A", the path of secondary auger carriage unit 21 is designated by the letter "B", and the path of subordinate auger carriage unit 26 is designated by the letter "C", while the link of continuous flexible chain 43 to which linkage rod 44 is attached makes one complete circuit beginning approximately at drive sprocket wheel 38 and moving towards apex sprocket wheel 41. The dashed lines in FIG. 2 indicate the path of subordinate auger carriage unit 26 when continuous flexible chain 43 makes one more complete circuit.

As can be seen in FIG. 3, minor segment 18 of support member 16 serves as a support for electrical motor 46 for driving both main shaft and bearing assembly 14 and carriage drive sprocket wheel and bearing assembly 38, as well as carriage drive gear assembly for transferring power from main shaft and bearing assembly 14 to carriage drive sprocket wheel and bearing assembly 38. Main shaft gear assembly 48 provides for the transmission of power from electric motor 46 to main shaft 14 and spring clutch assembly 49 provides for the disengagement of electric motor 46 with main shaft 14. As motor 46 turns main shaft 14, traction wheel 12 turns on track assembly 13, thus propelling the apparatus in an arcuate path around the bin.

Obviously, numerous modifications and variations of the present invention are possible in light of the above teachings. It is therefore to be understood that within the scope of the appended claims, the invention may be practiced otherwise than as specifically described herein.

I claim:

1. An improved grain stirring apparatus for operation within a circular grain bin comprising:

a first carriage means, having down auger means for stirring stored grain rigidly affixed thereto, for movement radially back and forth along no more than approximately a one-third portion of a major segment lying between the bin center and the bin wall, of a radially-extended horizontal support member, said member also having a minor segment extending beyond the bin center, mounted in the bin for arcuate movement of both the major and the minor segments about the bin center above the grain storage level;

a second carriage means with rigid connection means to the first carriage means for movement therewith along the major segment of the horizontal support member, including:

an open framework means for unobstructed radial movement of a third carriage means, having down auger means for stirring grain rigidly affixed thereto, back and forth therewithin along a portion of the horizontal support member twice as long as the portion along which the first carriage means moves; and cable and pulley means interconnecting said second carriage means, said third carriage means, and said horizontal support member for moving said third carriage means along the horizontal support member a distance and at a speed twice that of the first carriage means; and carriage drive means mounted on the minor segment of the horizontal support member for moving the rigidly connected first and second carriage means back and forth along the horizontal support member.

2. The improved grain stirring apparatus of claim 1 wherein the carriage drive means is further characterized by being programmed to move the carriage means a pre-determined distance and at a pre-determined, variable speed, including linkage means for translating the programmed motion from the programmed drive means to the first and second carriage means.

3. The improved grain stirring apparatus of claim 2 wherein the programmed carriage drive means further includes a continuous flexible chain means horizontally disposed about a carriage drive sprocket wheel means for receiving and transmitting power and for supporting the chain means secured to the minor segment of the horizontal support member and one or more guide sprocket wheel means which are secured to the minor segment of the horizontal support member for supporting the chain means in conjunction with the carriage drive wheel means in a fixed, predetermined pathway for programming the distance and speed of movement of the first and second carriage means wherein the linkage means is further characterized by being pivotally connected to a link of the chain means at one end and to the rigid connection means of the second carriage means at the other end.

4. The improved grain stirring apparatus of claim 3 wherein the programmed carriage drive means is further characterized by having two guide wheel means which, in conjunction with the drive wheel, form an isosceles triangle with its base proximal to the bin center, normal to the support member and substantially shorter in length than its other legs, the length of said other legs being approximately equal to the desired distance of travel for the first and second carriage means.

5. The improved grain stirring apparatus of claim 3 wherein the horizontal support member is further characterized by being hollow and further comprises:

an electric motor mounted on the minor segment of the horizontal support member;

a main shaft means mounted within the horizontal support member and connected to the electric motor for delivering power to move the horizontal support member about the bin center and for turning the carriage drive wheel means; and a horizontal support member traction wheel means, co-axially mounted on the main shaft distal the bin center, for moving the horizontal support member in an arcuate path on a track affixed to the bin wall.

6. The improved grain stirring apparatus of claim 3 further including clutch means for connecting and disconnecting the delivery of power from the electric motor to the shaft means.

7. The improved grain stirring apparatus of claim 5 wherein the horizontal support member further comprises:

gearing means for transmitting power from the electric motor to the main shaft;

gearing means for transmitting power from the main shaft to the carriage drive wheel.

8. The improved grain stirring apparatus of claim 1 further comprising a secondary first carriage means, having rigid connection means for spacing it apart from the first and second carriage means a distance equal to that portion of the horizontal support member along which the first carriage means moves, for movement therewith along a portion of the major segment of the horizontal support member.

9. The improved grain stirring apparatus of claim 8 further characterized by having one first carriage means for movement along the horizontal support member a distance equal to approximately one-fourth the major segment thereof, said portion located adjacent the grain bin wall, one second carriage means for movement of its third carriage means along the horizontal support member a distance equal to approximately one-half the major segment thereof, said portion located adjacent the bin center, and one secondary first carriage means for movement along the horizontal support member a distance equal to approximately one-fourth the major segment thereof, said portion located between the first carriage means and the second carriage means.

10. The improved grain stirring apparatus of claim 1 wherein the cable and pulley means includes two pulley means mounted at substantially the horizontal extremeties of the open framework means of the second carriage means for holding and permitting the movement of a continuous cable means encircling the two pulley means and connected at a first point to the horizontal support member at a point thereon centered between the backwards-most and forwards-most travel position of said second carriage means and at a second point, half the length of the cable away from the first point to the third carriage means.

* * * * *